US007931780B2

(12) United States Patent
Inoue

(10) Patent No.: US 7,931,780 B2
(45) Date of Patent: Apr. 26, 2011

(54) WET PAPER WEB TRANSFER BELT

(75) Inventor: Kenji Inoue, Tokyo (JP)

(73) Assignee: Ichikawa Co. Ltd., Tokyo (JP)

( * ) Notice: Subject to any disclaimer, the term of this patent is extended or adjusted under 35 U.S.C. 154(b) by 460 days.

(21) Appl. No.: 12/084,856

(22) PCT Filed: Oct. 2, 2006

(86) PCT No.: PCT/JP2006/320141

§ 371 (c)(1),
(2), (4) Date: May 12, 2008

(87) PCT Pub. No.: WO2007/055076

PCT Pub. Date: May 18, 2007

(65) Prior Publication Data

US 2009/0095433 A1 Apr. 16, 2009

(30) Foreign Application Priority Data

Nov. 14, 2005 (JP) ..... 2005-328814

(51) Int. Cl.
*D21F 3/02* (2006.01)
*D21F 2/00* (2006.01)

(52) U.S. Cl. ..... 162/306; 162/358.4; 162/901; 442/118

(58) Field of Classification Search ..... 162/306, 162/358.1, 358.2, 358.4, 900–903; 442/118
See application file for complete search history.

(56) References Cited

U.S. PATENT DOCUMENTS 6,605,188 B2 * 8/2003 Hagfors et al. ..... 162/306
2004/0065528 A1 * 4/2004 Inoue ..... 198/699.1

FOREIGN PATENT DOCUMENTS

JP 2001-89990 4/2001
JP 2004-277971 10/2004
JP 2004-285511 10/2004

* cited by examiner

*Primary Examiner* — Eric Hug
(74) *Attorney, Agent, or Firm* — Howson & Howson LLP

(57) ABSTRACT

A wet paper web transfer belt comprises a base body 30, a paper side layer 20, and a machine side layer 23. The paper side layer 20 is composed of a paper contacting side batt layer 21 made of hydrophilic fibers 41 and a base bode side batt layer 22 without the hydrophilic fibers 41, at least the paper contacting side batt layer 21 being impregnated with a high molecular weight elastic body 50 and at least a part of the hydrophilic fibers 41 being exposed on the surface of the paper contacting side batt layer 21. The water contained in the wet paper web remains within the paper contacting side batt layer 21 made of the hydrophilic fibers 41 with only a small amount of water moving into the base body side batt layer 22, thereby reducing dimensional changes of the belt. Further, since the water contained in the wet paper web remains within the hydrophilic fibers 41 exposed on the surface of the paper side layer 20, the belt is capable of transferring the wet paper web attached thereon while allowing smooth detachment when transferring it to the next process.

2 Claims, 5 Drawing Sheets

WET PAPER WEB TRANSFER BELT

FIELD OF THE INVENTION

This invention relates to a wet paper web transfer belt (hereinafter also referred to as a "belt"), and specifically to such a belt for transferring a wet paper web at high speed.

BACKGROUND ART

Recently, closed draw papermaking machines have been developed to speed up papermaking operation.

A typical closed draw papermaking machine is shown in FIG. 5.

A wet paper web WW, shown as a broken line in the figure, is supported or held by press felts PF1, PF2, a wet paper web transfer belt TB, and a dryer fabric DF, and transferred from the right to the left. The press felts PF1, PF2, the wet paper web transfer belt TB, and the dryer fabric DF are, as is generally known, endless belts and supported by guide rollers GR. A shoe PS has a concave bottom which conforms to the press roll PR. The shoe PS and the press roll PR, with a shoe press belt SB in-between, compose a press part PP.

The wet paper web WW, after traveling through a wire section and a first press part (not shown in the figure), is transferred from the press felt 1 onto the press felt 2. It is then transferred to the press part PP by the press felt 2, where the wet paper web WW, sandwiched between the press felt PF2 and the wet paper web transfer belt TB, is compressed by the shoe PS and the press roll PR with the shoe press belt SB in-between.

The press felt PF2 is provided with high water permeability, whereas the wet paper web transfer belt TB has a very low permeability. Accordingly, within the press part PP, the water contained in the wet paper web WW moves into the press felt PF2. The press felt PF2, the wet paper web WW, and the wet paper web transfer belt TB, rapidly released from the compression upon leaving the press part PP, back to their uncompressed state. The expansion of their volume, coupled with the capillary phenomenon, causes rewetting in which some of the water within the press felt PF2 backs to the wet paper web WW. However, the wet paper web transfer belt TB does not hold water therein because of its low permeability. Thus, the wet paper web transfer belt TB causes little or no rewetting and hence facilitates dewatering of the wet paper web. The wet paper web WW, after exiting the press part PP, is transferred by the wet paper web transfer belt TB. The wet paper web WW is then sucked onto a suction roll SR and a dryer fabric DF transfers it to a drying section.

The wet paper web transfer belt TB is required to allow smooth detachment of the wet paper web when it transfers the paper web to the next process.

An example of the wet paper web transfer belt with such a function is disclosed in Unexamined Japanese Patent Publication No. 89990/2001, in which a paper side layer comprises a high molecular weight elastic section and a fiber body, either of which is made from a hydrophobic material. According to this invention, a thin water film formed between the wet paper web and the wet paper web transfer belt gets broken after the paper web travels out of the press section due to the effect of the hydrophobic material, which enables smooth transfer of the wet paper web to the next process.

On the other hand, another important consideration has become increasingly recognized that the wet paper web transfer belt should be capable of having the wet paper web attached securely thereon at the exit of the press section.

While the wet paper web transfer belt disclosed in the Unexamined Japanese Patent Publication No. 89990/2001 is capable of having the wet paper web detached smoothly therefrom, it has a problem that the paper web sometimes gets torn during and at the time of transferring to the next process, because the thin water film between the paper web and the belt gets broken at the exit of the press section and thus the paper web does not securely stick to the surface of the belt upon exiting the press section.

With the object to solve this problem, the inventor of the present invention proposed, in Unexamined Japanese Patent Publication No. 277971/2004, a wet paper web transfer belt with a paper side layer which comprises a high molecular weight elastic section and a fiber body, a part of the fiber body being exposed on the surface of the belt. According to this invention, since hydrophilic fibers exposed on the surface of the paper side layer holds the water removed from the wet paper web, the belt is capable of transferring the wet paper web attached thereon while allowing smooth detachment of the paper web when transferring it to the next process.

DISCLOSURE OF THE INVENTION

However, the wet paper web transfer belt disclosed in the Unexamined Japanese Patent Publication No. 277971/2004 was dimensionally unstable due to the expansion of the hydrophilic fibers in the paper side layer, as they absorb some of the water contained within the wet paper web. In the paper side layer of the wet paper web transfer belt, rayon fibers or nylon fibers with the high official moisture regain are employed as fibers to compose a batt layer. It is generally known that when batt layers have the high official moisture regain, a substantial change in its dimensions does occur due to absorption of water. A wet paper web transfer belt with a batt layer which is susceptible to a substantial change in its dimensions tends to extend in the running direction or in the width direction, or to run with a corrugated surface thereon because of partial elongation.

It is generally recognized that such a change in dimensions increases proportionately to the official moisture regain. However, a batt layer composed of fibers with the low official moisture regain often impairs the function of a wet paper web transfer belt.

In the light of above-mentioned problems, the present invention aims to provide a wet paper web transfer belt which is capable of transferring the wet paper web attached thereon while allowing smooth detachment of the paper web when transferring it to the next process and which is at the same time dimensionally stable.

The present invention solves the problem with a wet paper web transfer belt used in the press part of a closed draw papermaking machine which has a base body, a paper side layer, and a machine side layer, said paper side layer comprising a paper contacting side batt layer made of hydrophilic fibers and a base body side batt layer without said hydrophilic fibers, at least said paper contacting side batt layer being impregnated with a high molecular weight elastic body, characterized in that at least a part of said hydrophilic fibers is exposed on the surface of said paper contacting side batt layer.

The gap in the official moisture regain of said hydrophilic fibers and fibers of the base body side batt layer without the hydrophilic fibers is preferably 4.0% or more.

The wet paper web transfer belt of this invention has two layers within the paper side layer, the paper contacting side batt layer comprising hydrophilic fibers and the base body side batt layer having no hydrophilic fibers, which means more water removed from the paper web remains within the paper contacting side batt layer and less water goes into the base body side batt layer. As a result, the paper contacting side batt layer does expand whereas the base body side batt layer does not, which means the expansion of the paper side layer of the wet paper web transfer belt is small as a whole and the change in its dimensions is also small.

In addition, since the water removed from the wet paper web remains in the paper side layer because of the hydrophilic fibers exposed on its surface, the belt is capable of transferring the wet paper web attached thereon while allowing smooth detachment of the paper web when transferring it to the next process.

PREFERRED EMBODIMENTS OF THE INVENTION

The wet paper web transfer belt of this invention is to be detailed.

Figure 1:
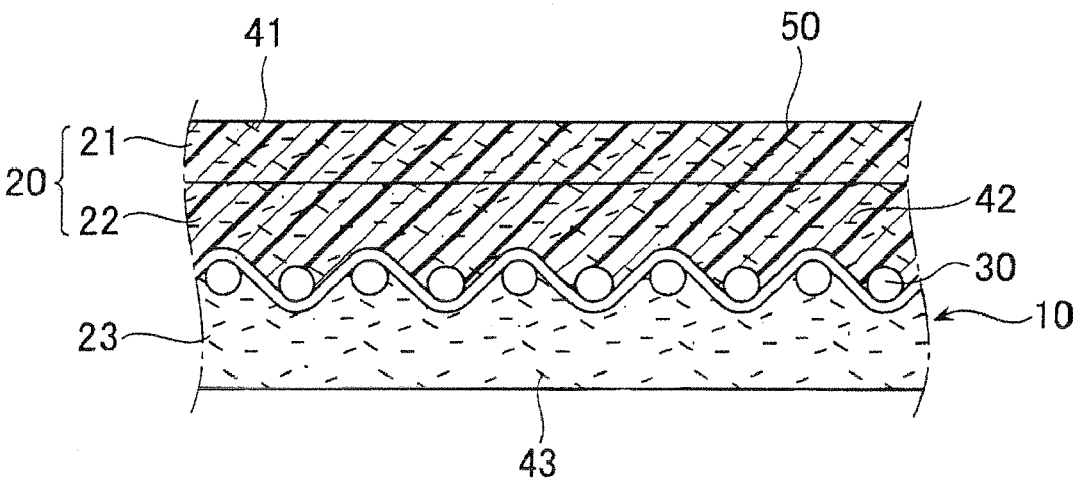
FIG. 1 is a CMD cross-sectional schematic view of a first embodiment of the wet paper web transfer belt of the present invention.
Figure 2:
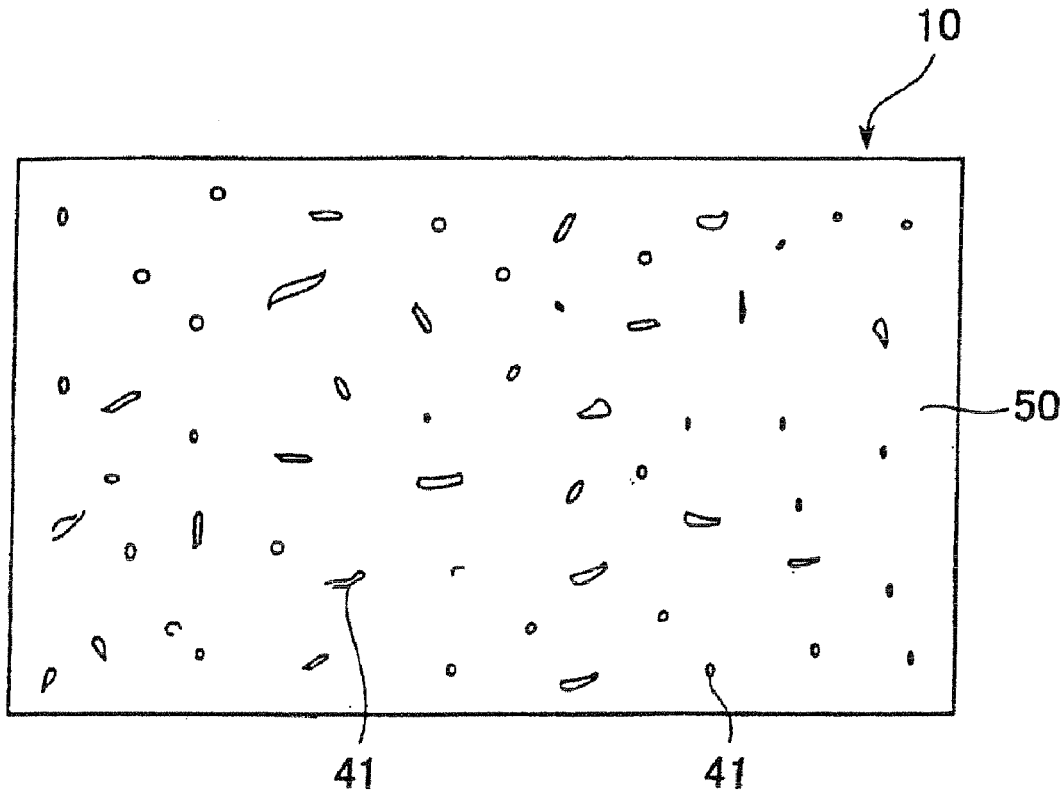
FIG. 2 is a schematic plan view of the wet paper web transfer belt of the present invention.

FIG. 1 is a CMD cross-sectional schematic view of a first embodiment of the wet paper web transfer belt of the present invention and FIG. 2 is a plan view.

As shown in FIG. 1, the wet paper web transfer belt 10 comprises the base body 30, the paper side layer 20, and the machine side layer 23, the paper side layer 20 comprising two layers, the paper contacting side batt layer 21 and the base body side layer 22 disposed below the paper contacting side batt layer 21.

While the paper contacting side batt layer 21 is made of hydrophilic fibers 41, the base body side batt layer 22 does not contain the hydrophilic fibers 41 and is made of fibers with the lower official moisture regain compared to the hydrophilic fibers 41. Therefore, the paper contacting side batt layer 21 has a higher water absorption rate than the base body side batt layer 22.

The paper contacting side batt layer 21 and the base body side batt layer 22 are impregnated with a high molecular weight elastic body 50. As illustrated in FIG. 2, the hydrophilic fibers 41 are partially exposed on the surface of the paper contacting side batt layer 21.

"(Being) exposed" means a state where a hydrophilic fiber 41 appears on the surface of the paper contacting side batt layer 21, regardless of whether it protrudes therefrom. Accordingly, FIG. 2 depicts but one example of the exposure of the hydrophilic fibers 41 on the surface of the paper contacting side batt layer 21 and other forms of exposure are also possible.

For simplicity, the paper contacting side batt layer 21 is hereinafter referred to as a "first batt layer," the base body side batt layer 22 as a "second batt layer," and the machine side layer 23 as a "third batt layer."

The first batt layer 21, the second batt layer 22, and the third batt layer 23 are made of staple fibers, which are hydrophilic fibers 41 for the first batt layer 21 and, as described later, fibers with the lower official moisture regain than the hydrophilic fibers 41 for the second and third batt layers 22 and 23.

The second batt layer 22 and the third batt layer 23 are needlepunched together to be intertwined with the paper side and the machine side of the base body 30 respectively. Such batt layers can be formed by way of electrostatic flocking instead of needlepunching.

The word "hydrophilic" of the hydrophilic fibers 41 composing the first batt layer 21 means such characteristics as to absorb and/or hold water therein which is herein shown as "the official moisture regain" listed in JIS L0105 (general rules for physical testing of textiles).

Those fibers with the official moisture regain of 4% or more are preferably used as the hydrophilic fibers 41, and specifically can be chosen from a group of such fibers as nylon (the official moisture regain: 4.5%), vinylon (5.0%), acetate (6.5%), rayon (11.0%) polynosic (11.0%), cupra (11.0%), cotton (8.5%), hemp (12.0%), silk (12.0%), and wool (15.0%). The numbers in the parentheses are their respective official moisture regain. When fibers with the official moisture regain of less than 4% are employed, the wet paper web transfer belt is incapable of transferring the paper web attached securely thereon due to such fibers' inability to hold water removed from the wet paper web.

Other candidates for the hydrophilic fibers 41 are fibers with a chemically-treated hydrophilic surface, specifically, those with mercerization, resin treatment, sputtering with ionizing radiation, glow discharging etc, which are known to those skilled in the art. During the chemical processing, the humidity should be conditioned so that the moisture content of the processed monofilament or spun yarn will be in the range of 30 to 50%, with the water contact angle less than 30 degrees, to obtain excellent results. Said percentages for the water content of the monofilament or the yarn are calculated based on the following formula: (weight of water/total weight)×100.

The first and second batt layers 21 and 22 are impregnated with a high molecular weight elastic body 50 and hardened, and then ground with a sandpaper or a grind stone to make the hydrophilic fibers 41 exposed on the surface of the first batt layer 21.

The hydrophilic fibers 41 preferably have strength of 0.8 g/dtex or more to avoid ablation in the process of grinding.

The second batt layer 22 are made of fibers 42 which are less hydrophilic than, or with the official moisture regain lower than, the hydrophilic fibers 41, so that the water within the hydrophilic fibers 41 is prevented from moving into the second batt layer 22. Specifically, it can be the one with a difference in the official moisture regain of 4% or more as compared to the hydrophilic fibers 41, chosen from said group of hydrophilic fibers with the official moisture regain of 4% or more, or can be chosen from a group of such fibers with the low official moisture regain as vinylidene (the official moisture regain: 0%), polyvinyl chloride (0%), polyethylene (0%), polypropylene (0%), polyester (0.4%), aromatic polyamide (0.4%), polyurethane (1.0%), and acrylic (2.0%). Among those, polyester fibers are preferably employed for their persistent strength.

Fibers 43 used for the third batt layer 23 may or may not be the same as the fibers 42 for the second batt layer 22.

When the third batt layer 23 is made of different fibers from those used for the second batt layer 22, the fibers 42 for the second batt layer 22 can be polyester fibers with the low official moisture regain and the fibers 43 for the third batt layer 23 which contacts rolls can be a blend of polyester fibers and nylon fibers with strong abrasion-resistant characteristics.

The basis weight of the first and second batt layers 21 and 22 composing the paper side layer 20 and the third batt layer 23 is in the range of 50-600 g/m$^2$, 100-600 g/m$^2$, and 0-600 g/m$^2$ respectively.

Figure 3:
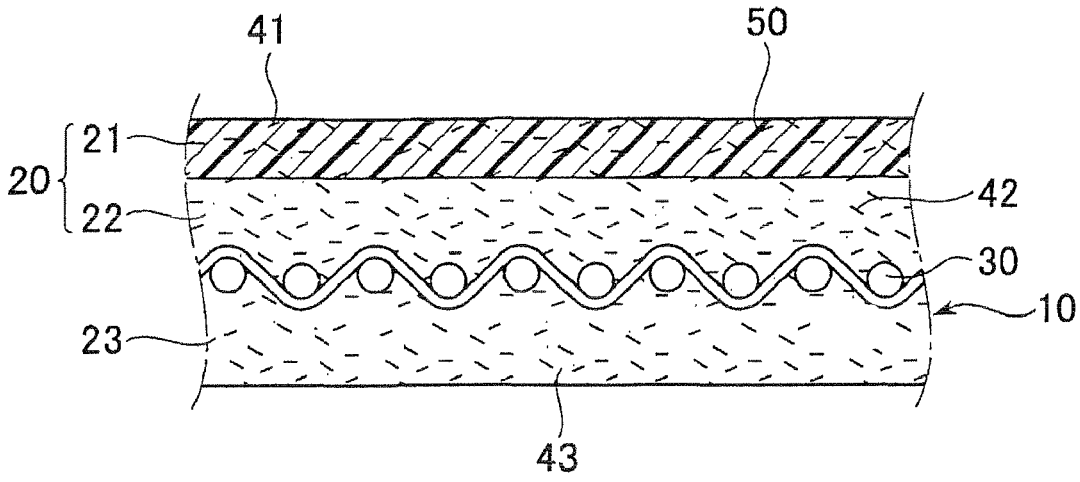
FIG. 3 is a CMD cross-sectional schematic view of a second embodiment of the wet paper web transfer belt of the present invention.

FIG. 3 is a CMD cross-sectional schematic view of the second embodiment of the wet paper web transfer belt of the present invention.

In the wet paper web transfer belt 10 as the second embodiment, only the first batt layer 21 is impregnated with the high molecular weight elastic body 50.

The hydrophilic fibers 41 for the first batt layer 21 and the fibers 42 and 43 for the second and third layers 22 and 23, and the method to make the part of the hydrophilic fibers 41 exposed on the surface of the first batt layer 21 after hardening of the high molecular weight elastic body 50 are the same as the first embodiment.

Though not shown in drawings, another embodiment is possible in which the base body 30 and the third batt layer 23 can also be impregnated with the high molecular weight elastic body 50, which means the wet paper web transfer belt 10 is impregnated with high molecular weight elastic body 50 as a whole.

Thermosetting resin such as urethane, epoxy, and acrylic, or thermoplastic resin such as polyamide, polyarylate, and polyester can be used as the high molecular weight elastic body 50.

The base body 30, as illustrated in FIGS. 1 and 3, is preferably a fabric woven with MD yarns and CMD yarns, but not limited to such a configuration and various alternatives are available; it can be a film, a knitting, or can be formed by simply putting MD yarns and CMD yarns on each other, or by coiling a thin band form to make a wide band form.

The wet paper web transfer belt 10 is preferably made nonporous. However, a certain level of air permeability may be required for some papermaking machines. In such cases, a belt with desirable aeration properties can be obtained by reducing the amount of the high molecular weight elastic body, applying more intense grinding, or employing the high molecular weight elastic body with interconnected bubbles therein.

Considering the role of the wet paper web transfer belt, however, air permeability should be preferably not over 2 cc/cm$^2$/sec in the cases above. The air permeability is measured using A method (a Frazier type air permeability tester) specified in JIS L 1096.

The wet paper web transfer belt of the present invention is to be specifically described using the following embodiments. However, other embodiments are also possible.

Embodiment 1

Step 1: A plain-woven fabric (basis weight: 400 g/m$^2$) made of a nylon thread (plied with three single yarns with 500 dtex) is used to make an endless base body. Nylon 6 (staple fibers with 20 dtex, the official moisture regain of 4.5%) and polyester fibers (staple fibers with 20 dtex, the official moisture regain of 0.4%) are needlepunched together with the woven fabric to be intertwined with the outer and inner circumferential surfaces thereof and form the second and third batt layers (basis weight. 300 g/m$^2$) on the front and back sides of the base body (woven fabric) respectively.

Further, the first batt layer (basis weight: 200 g/m$^2$) is formed by needlepunching hydrophilic rayon fibers (staple fibers with 6 dtex, the official moisture regain of 11%) on the surface of the second batt layer and thus a needlepunched felt with the density of 0.45 g/cm$^3$ is made.

Step 2: The density of the staple fibers is made about 0.50 g/cm$^3$ by applying thermal pressurization to the needlepunched felt.

Step 3: The needlepunched felt is impregnated with the urethane resin, a high molecular elastic body, from the outer circumferential surface to its middle, which means the first and second batt layers are impregnated with the urethane resin (impregnation rate: 1000 g/m$^2$).

Step 4: The urethane resin is hardened.

Step 5: The outer circumferential surface of the urethane resin is ground with a sand paper.

Thus, a belt is made with rayon fibers exposed on its outer circumferential surface (the surface of the paper side layer)

Embodiment 2

A belt with rayon fibers exposed on its surface is made in the same way as in Embodiment 1 explained above, except that in the step 3, only the first batt layer is made impregnated with the urethane resin by using a barcoater (impregnation rate: 400 g/m$^2$).

Embodiment 3

A belt with rayon fibers exposed on its surface is made in the same way as in Embodiment 1, except that in the step 1, polyester fibers (staple fibers with 20 dtex, the official moisture regain of 0.4%) are needlepunched together with the woven fabric to be intertwined with the outer and inner circumferential surfaces thereof and form the second and third batt layers (basis weight: 300 g/m$^2$) on the front and back sides of the base body (woven fabric).

Embodiment 4

A belt with nylon 6 fibers exposed on its surface is made in the same way as in Embodiment 1, except that in the step 1 of Embodiment 3 described above, hydrophilic nylon 6 (staple fibers with 6 dtex, the official moisture regain of 4.5%) is needlepunched onto the surface of the second batt layer to form the first batt layer (basis weight: 200 g/m$^2$) and to make a needlepunched felt with the density of 0.45 g/cm$^3$.

Comparative Example 1

A belt with rayon fibers exposed on its surface is made in the same way as in Embodiment 1 explained above, except that in the step 1, rayon is used for the outer and inner circumferential surfaces of the woven fabric to form the second and third batt layers.

Comparative Example 2

A belt with polyester fibers exposed on its surface is made in the same way as in Embodiment 1 described above, except that in the step 1, polyester fibers (staple fibers with 6 dtex, the official moisture regain of 0.4%) is needlepunched onto the surface of the second batt layer to form the first batt layer (basis weight. 200 g/m$^2$).

Figure 4:
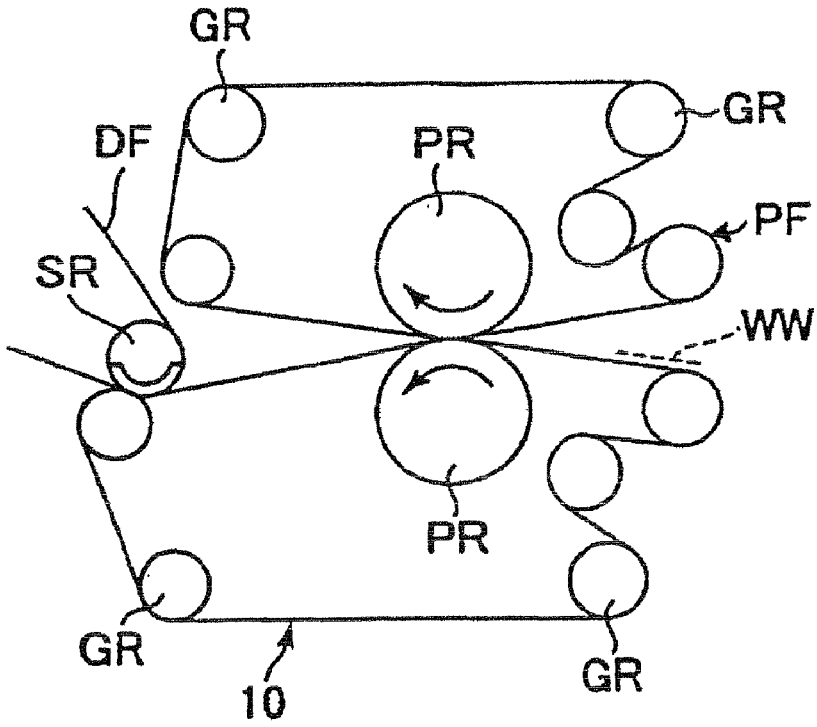
FIG. 4 is a schematic view of an apparatus to evaluate the performance of the embodiments of the wet paper web transfer belt.
Figure 5:
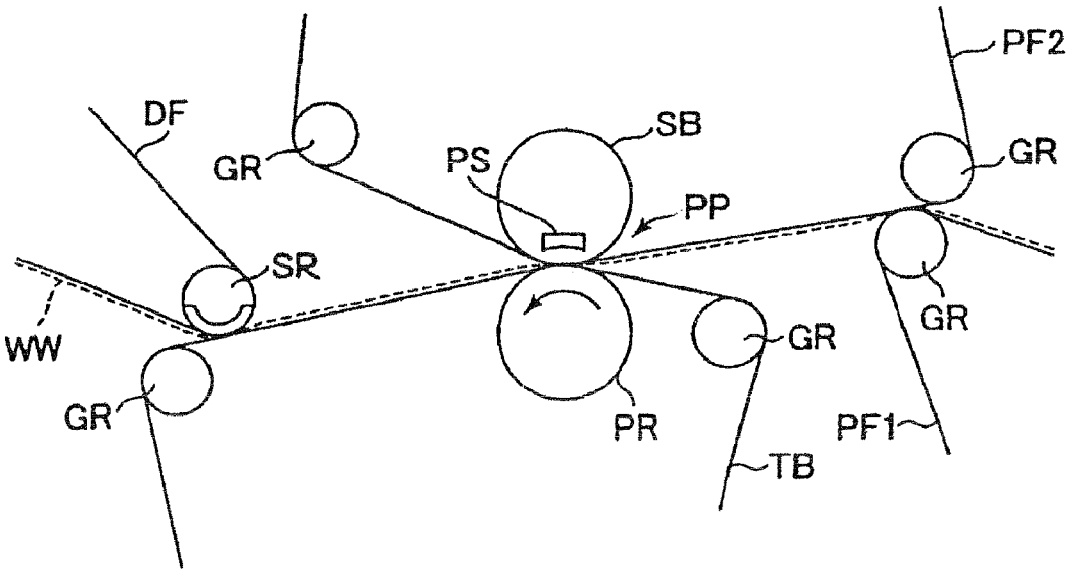
FIG. 5 is a schematic view of a typical closed draw papermaking machine.

Following tests were preformed with these wet paper web transfer belts using the apparatus shown in FIG. 4.

The apparatus comprises a pair of press rolls PR, PR, composing a press section, a press felt PF and a wet paper web transfer belt 10 sandwiched between the press rolls PR, PR. The press felt PF and the wet paper web transfer belt 10 are supported and tensioned by guide rollers GR, and run with the rotation of the press rolls PR.

For simplicity, a drier fabric DF is only partially illustrated in the figure. In fact, it is an endless belt just like the wet paper web transfer belt 10, supported and run by the guide rollers GR.

In this apparatus, the wet paper web WW is laid on the wet paper web transfer belt 10 short of the press section. The wet paper web WW travels through the press section, transferred by the wet paper web transfer belt 10 to reach a suction roll SR, where it is suctioned up by the suction roll SR onto the drier fabric DF.

Performance tests were conducted with the wet paper web transfer belt to evaluate following three effects:

1. Smooth transfer of the wet paper web WW onto the wet paper web transfer belt 10 at the exit of the press section
2. Smooth transfer of the wet paper web onto the drier fabric DF
3. A change in the dimensions of the wet paper web transfer belt, which is measured by comparing a belt after 100 hours of testing to a belt immediately after the start of the testing, where the dimensions (both in the running direction and the width direction) of the latter are regarded 100.

Tests 1 and 2 are visually determined.

In the testing, the driving speed of the apparatus is conditioned to be 150 m/min, the pressure at the press section to be 40 kg/cm, the vacuum of the suction roll SR to be 150 mmHg, the tension of the belt to be 4 kg/cm.

A paper web made from kraft pulp with the basis weight of 80 g/m$^2$ and the dryness of 50% is used as the wet paper web WW.

The press felt PF is a felt with a generally known structure which comprises a woven fabric and a batt layer needlepunched and intertwined together. The press felt PF has the basis weight of 1200 g/m$^2$, a batt layer with the fineness of 5.6 dtex, and the density of 0.45 g/cm$^3$.

The results of the tests are shown in Table 1.

As shown in Table 1, the belts of Embodiments 1-4 had low elongation rates both in the running and width direction, demonstrating improvements in dimensional stability compared to Comparative Example 1.

Further, it was determined that the belts of Embodiments 1-4 are capable of having the paper web attached securely thereon at the exit of the press part and smoothly transferring it to the next process, functions required for the wet paper web transfer belts.

While Comparative Example 1 was matched Embodiments in terms of the functions to have the paper web attached thereon and transfer it to the next process, the elongation rate was high and therefore exhibited no improvements in dimensional stability. It may be because all of the first, second, and third batt layers are made of hydrophilic fibers which absorb water and get swollen to extend in the running and width direction and become dimensionally unstable.

Further, while Comparative Example 2 matched Embodiments in terms of the changes in dimensions, it was incapable of having the wet paper web attached thereon after the paper web exit the press section, where the paper web was transferred onto the press felt. It may be because the first batt layer is made of polyester fibers with the low official moisture regain, which results in too many breakages in the thin water film created between the wet paper web and the belt right after the paper is released from compression.

What is claimed is:

1. A wet paper web transfer belt for use in the press part of a closed draw papermaking machine said belt comprising a base body, a paper side layer, and a machine side layer, wherein said paper side layer comprises a paper-contacting batt layer made of hydrophilic fibers the official moisture regain of which is at least 4.0% and a base body side batt layer made of fibers having an official moisture regain lower than the official moisture regain of said hydrophilic fibers of the paper-contacting batt layer by at least 4.0 percentage points on the official moisture regain scale, said base body side batt layer being disposed between said paper-contacting batt layer and said base body,

TABLE 1

| | Paper Side Layer | | Machine Side Layer | Attachment of paper web at | Transfer of paper web to next | Elongation rates | |
|---|---|---|---|---|---|---|---|
| | First Batt Layer | Second Batt Layer | Third Batt Layer | press exit | process | after tests | |
| Embodiment 1 | Rayon | Nylon | Polyester | Good | Good | Running Direction | 0.5% |
| | | | | | | Width Direction | 1.5% |
| Embodiment 2 | Rayon | Nylon | Polyester | Good | Good | Running Direction | 1.0% |
| | | | | | | Width Direction | 2.0% |
| Embodiment 3 | Rayon | Polyester | Polyester | Good | Good | Running Direction | 0.5% |
| | | | | | | Width Direction | 1.0% |
| Embodiment 4 | Nylon | Polyester | Polyester | Good | Good | Running Direction | 0.5% |
| | | | | | | Width Direction | 1.0% |
| Comparative Example 1 | Rayon | Rayon | Rayon | Good | Good | Running Direction | 1.0% |
| | | | | | | Width Direction | 3.5% |
| Comparative Example 2 | Polyester | Nylon | Polyester | Failure | — | Running Direction | 0.5% |
| | | | | | | Width Direction | 1.0% |

wherein at least said paper-contacting batt layer is impregnated with high molecular weight elastic body, and wherein at least a part of said hydrophilic fibers is exposed on the surface of said paper-contacting batt layer.

2. A wet paper web transfer belt according to claim 1, wherein the basis weight of said base body side batt layer is in the range from 100 to 600 $g/m^2$.

* * * * *